US011105075B2

(12) United States Patent
Davidson et al.

(10) Patent No.: US 11,105,075 B2
(45) Date of Patent: Aug. 31, 2021

(54) ADJUSTABLE HEIGHT SHOWER HEAD ASSEMBLY

(71) Applicant: Delta Faucet Company, Indianapolis, IN (US)

(72) Inventors: Kyle Davidson, Noblesville, IN (US); Celine Garland, Zionsville, IN (US); Scott Sorrell, Fountaintown, IN (US)

(73) Assignee: Delta Faucet Company, Indianapolis, IN (US)

( * ) Notice: Subject to any disclaimer, the term of this patent is extended or adjusted under 35 U.S.C. 154(b) by 52 days.

(21) Appl. No.: 16/394,776

(22) Filed: Apr. 25, 2019

(65) Prior Publication Data

US 2019/0345700 A1 Nov. 14, 2019

Related U.S. Application Data

(60) Provisional application No. 62/668,530, filed on May 8, 2018.

(51) Int. Cl.

| | |
|---|---|
| ***E03C 1/06*** | (2006.01) |
| ***B05B 1/18*** | (2006.01) |
| ***E03C 1/02*** | (2006.01) |

(52) U.S. Cl.

CPC ..... *E03C 1/066* (2013.01); *B05B 1/185* (2013.01); *E03C 1/025* (2013.01)

(58) Field of Classification Search

CPC ..... E03C 1/066; E03C 1/06; E03C 1/063
USPC ..... 4/615
See application file for complete search history.

(56) References Cited

U.S. PATENT DOCUMENTS

| | | | |
|---|---|---|---|
| 2,776,168 | A | 1/1957 | Schweda |
| 3,982,285 | A | 9/1976 | Roberts, Jr. |
| 4,523,604 | A | 6/1985 | Hutto |
| 4,809,369 | A | 3/1989 | Bowden |
| 4,997,007 | A | 3/1991 | Niemann et al. |
| 5,291,622 | A | 3/1994 | Humpert |
| 5,329,650 | A | 7/1994 | Zaccai et al. |
| 5,339,469 | A | 8/1994 | Gilles |
| 6,038,715 | A | 3/2000 | Flieger et al. |
| 6,829,790 | B2 | 12/2004 | Petrovic et al. |
| 6,832,784 | B1 | 12/2004 | Chen |
| 6,859,955 | B2 | 3/2005 | Hudson |
| 6,913,211 | B2 | 7/2005 | Chen |

(Continued)

FOREIGN PATENT DOCUMENTS

| | | |
|---|---|---|
| CN | 2915961 Y | 6/2007 |
| CN | 206139399 U | 5/2017 |

(Continued)

*Primary Examiner* — Christine J Skubinna
(74) *Attorney, Agent, or Firm* — Bose McKinney & Evans LLP

(57) ABSTRACT

A shower head assembly includes a base configured to be coupled to a building structure. A neck is translatably coupled to the base, and flexible tubing is coupled to and configured to receive water from a shower head pipe. A shower head spout is configured to receive water from the flexible tubing and discharge water from the shower head assembly. The shower head spout is coupled to the neck and is translatable with the neck relative to the base to facilitate adjustment of the position of the shower head spout relative to the base. A securing mechanism selectively inhibits translation of the neck and the shower head spout relative to the base.

24 Claims, 15 Drawing Sheets

(56) References Cited

U.S. PATENT DOCUMENTS

| | | | |
|---|---|---|---|
| 7,197,776 | B2 | 4/2007 | Tsai |
| 7,299,510 | B2 | 11/2007 | Tsai |
| 7,356,857 | B2 | 4/2008 | Rosenberg |
| 7,406,984 | B2 | 8/2008 | Nikles et al. |
| 7,458,112 | B1 | 12/2008 | Yang |
| 7,857,241 | B2 | 2/2010 | Deng |
| 7,770,822 | B2 | 8/2010 | Leber |
| 7,959,191 | B2 | 6/2011 | Schouten |
| 8,104,111 | B2 | 1/2012 | Gross |
| 8,156,579 | B2 | 4/2012 | Renfrew |
| 8,191,185 | B2 | 6/2012 | Tsai |
| 8,683,624 | B1 | 4/2014 | Zhadanov et al. |
| 8,684,039 | B2 | 4/2014 | Cai |
| 9,273,452 | B2 | 3/2016 | Wilson |
| 9,677,256 | B2 | 6/2017 | Wilson |
| 10,245,610 | B2 | 4/2019 | Johnson |
| 2002/0083518 | A1 | 7/2002 | D'Ugo |
| 2003/0226200 | A1 | 12/2003 | Charonis |
| 2005/0116062 | A1 | 6/2005 | Yang |
| 2005/0127211 | A1 | 6/2005 | Yeiser |
| 2006/0021131 | A1 | 2/2006 | Robert et al. |
| 2006/0196972 | A1 | 9/2006 | Kajuch |
| 2008/0179427 | A1* | 7/2008 | Burke ..... B29C 48/09 239/289 |
| 2009/0293190 | A1 | 12/2009 | Ringelstetter et al. |
| 2010/0037389 | A1 | 2/2010 | Gross |
| 2010/0180376 | A1 | 7/2010 | Deng |
| 2012/0151669 | A1 | 6/2012 | Wilsoon |
| 2012/0325353 | A1 | 12/2012 | Zhou |
| 2015/0158047 | A1 | 6/2015 | Johnson et al. |
| 2016/0177552 | A1 | 6/2016 | Wilson |
| 2017/0233988 | A1 | 8/2017 | Wilson |
| 2019/0239700 | A1* | 8/2019 | Wang ..... A47K 3/281 |

FOREIGN PATENT DOCUMENTS

| | | | |
|---|---|---|---|
| CN | 107587568 | A | 1/2018 |
| CN | 107829470 | A | 3/2018 |

* cited by examiner

ADJUSTABLE HEIGHT SHOWER HEAD ASSEMBLY

CROSS-REFERENCE TO RELATED APPLICATION

The present application claims priority to U.S. Provisional Patent Application Ser. No. 62/668,530, filed May 8, 2018, the disclosure of which is expressly incorporated herein by reference.

BACKGROUND AND SUMMARY OF THE DISCLOSURE

The present disclosure relates to adjustable height shower head assemblies. More particularly, the present disclosure relates to adjustable height shower head assemblies including exposed flexible water delivery tubing.

Shower head assemblies are typically installed at a height that is slightly greater than the height of average individuals. Accordingly, most shower head assemblies are appropriate for use by average-height individuals. However, shower head assemblies can be difficult to use for individuals of certain different heights. For example, relatively tall individuals may need to crouch or duck to use a shower head assembly, which can be uncomfortable or even painful. Similarly, relatively short individuals may desire to have the shower head assembly closer to his/her body.

In an illustrative embodiment of the present disclosure, a shower head assembly includes a base that is configured to be coupled to a building structure. A neck is translatably coupled to the base, and flexible tubing is coupled to and configured to receive water from a shower head pipe. The flexible tubing extends external to and above the neck. A shower head spout is configured to receive water from the flexible tubing and discharge water from the shower head assembly. The shower head spout is coupled to the neck and is translatable with the neck relative to the base to facilitate adjustment of the position of the shower head spout relative to the base. A securing mechanism selectively inhibits translation of the neck and the shower head spout relative to the base.

In another illustrative embodiment of the present disclosure, a shower head assembly includes a base that is configured to be coupled to a building structure. A neck is translatably coupled to the base. Flexible tubing is coupled to and configured to receive water from a shower head pipe. A shower head spout is configured to receive water from the flexible tubing and discharge water from the shower head assembly. The shower head spout is coupled to the neck and is translatable with the neck relative to the base to facilitate adjustment of the position of the shower head spout relative to the base. A securing mechanism is selectively reconfigurable between a first configuration and a second configuration. In the first configuration, the securing mechanism inhibits the neck and the shower head spout from translating relative to the base. In the second configuration, the securing mechanism permits the neck and the shower head spout to translate relative to the base.

In another illustrative embodiment of the present disclosure, a shower head assembly includes a base that is configured to be coupled to a building structure. A neck is translatably coupled to the base. Flexible tubing is coupled to and is configured to receive water from a shower head pipe. A shower head spout is configured to receive water from the flexible tubing and discharge water from the shower head assembly. The shower head spout is coupled to the neck and translatable with the neck relative to the base to facilitate adjustment of the position of the shower head spout relative to the base. A securing mechanism inhibits translation of the neck and the shower head spout relative to the base. The securing mechanism includes a roller device that engages the neck, and the roller device rotates as the neck translates relative to the base. The securing mechanism further includes a securing element that engages the neck opposite the roller device.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the disclosure described herein are not intended to be exhaustive or to limit the disclosure to the precise forms disclosed. Rather, the embodiments described herein enable one skilled in the art to practice the disclosure.

Figure 1:
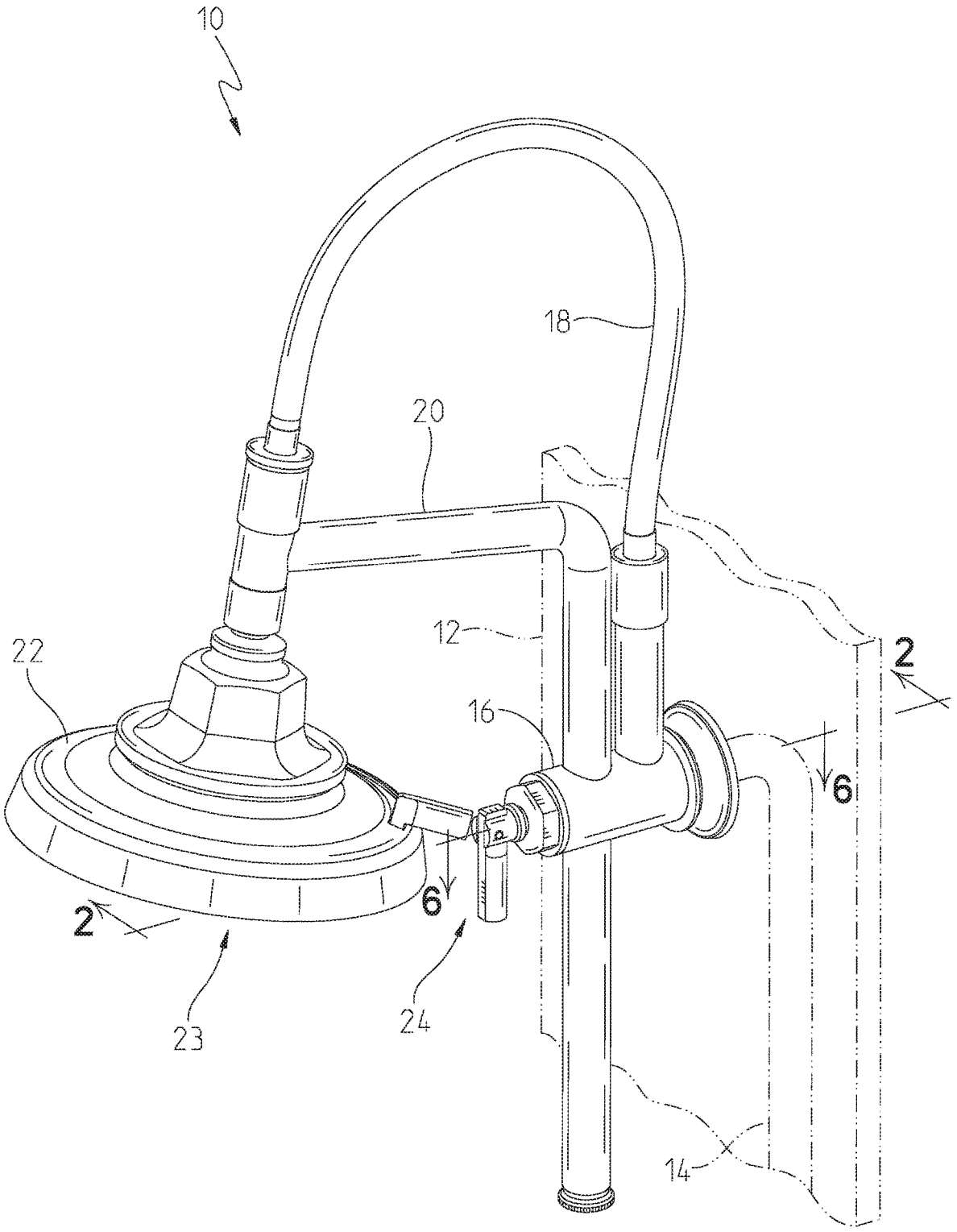
FIG. 1 is a perspective view of an illustrative shower head assembly of the present disclosure mounted to a wall and a shower head pipe.
Figure 2:
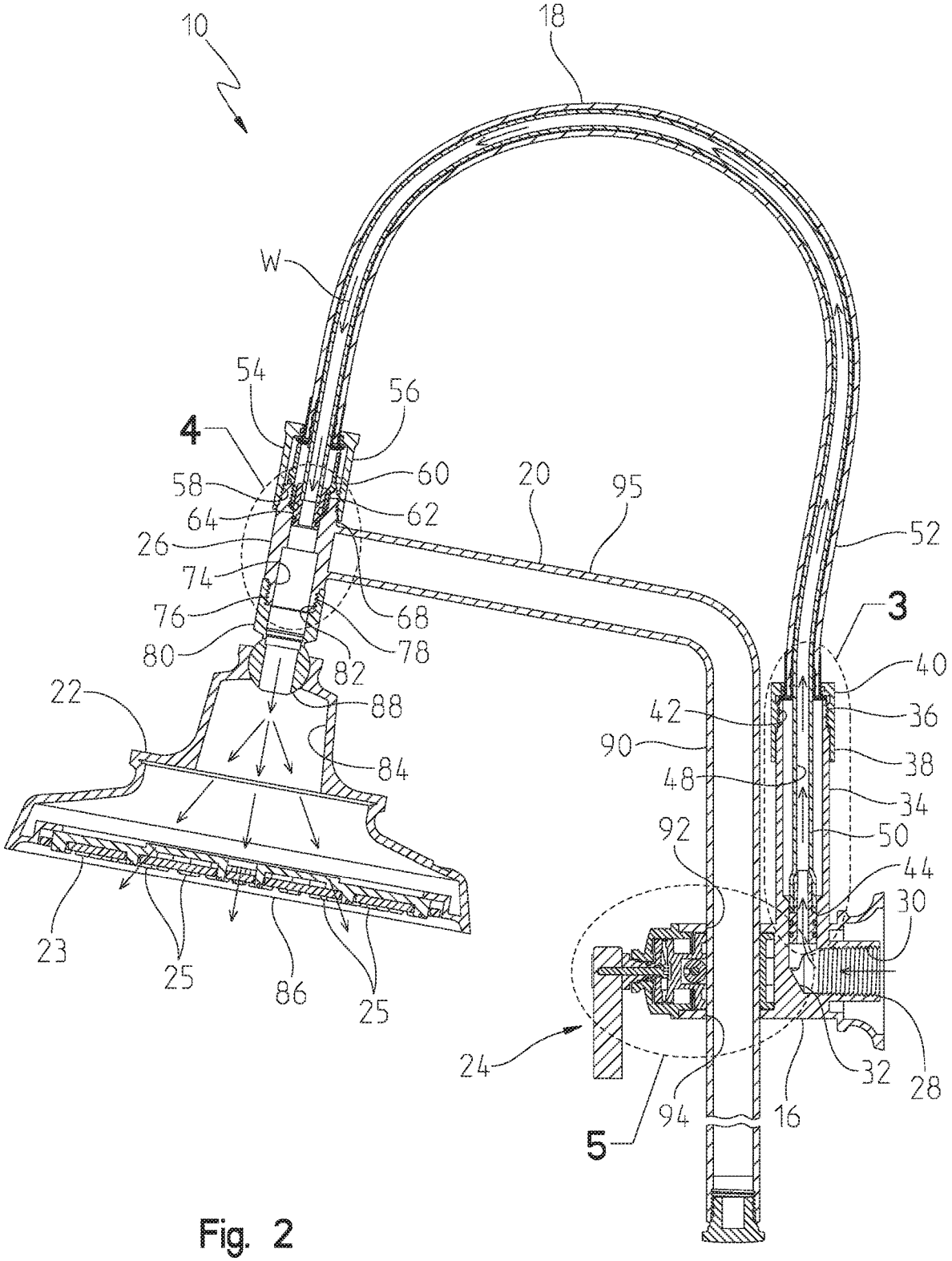
FIG. 2 is a side cross-sectional view of the shower head assembly taken along line 2-2 of FIG. 1.

Referring initially to FIGS. 1 and 2, an illustrative shower head assembly 10 is shown coupled to a building structure (illustratively, a wall 12) and a shower head pipe or riser 14. The shower head pipe 14 delivers water to the shower head assembly 10. Generally, the shower head assembly 10 includes a base 16 that couples to and receives water from the shower head pipe 14. The base 16 couples to and delivers water to exposed flexible tubing 18 (that is, tubing that is not carried within any other component of the shower head assembly 10). The flexible tubing 18 couples to and delivers water to a neck 20, which in turn couples to and delivers water to a shower head spout or spray head 22. The shower head spout 22 discharges water from the shower head assembly 10. More particularly, the shower head spout 22 includes a sprayface 23, and sprayface 23 includes a plurality of outlets 25 (for example, nozzles) to discharge water. The base 16 also couples to the neck 20, and a securing mechanism 24 carried by the base 16 facilitates selectively securing and permitting translation of the neck 20 relative to the base 16. As a result, the neck 20 and the shower head spout 22 are height-adjustable (that is, movable in a vertical direction relative to a shower basin), and the flexible tubing 18 facilitates water delivery from the base 16 to the shower head spout 22 at various heights of the shower head spout 22. These and other features of shower head assembly 10 are described further in the following paragraphs.

FIG. 2 is a side sectional view of the shower head assembly 10 that illustrates the path of water W through the shower head assembly 10. Generally, water flows from the base 16 through the flexible tubing 18, through a coupling portion 26 of the neck 20, to the shower head spout 22, and the shower head spout 22 discharges water from the shower head assembly 10.

Figure 3:
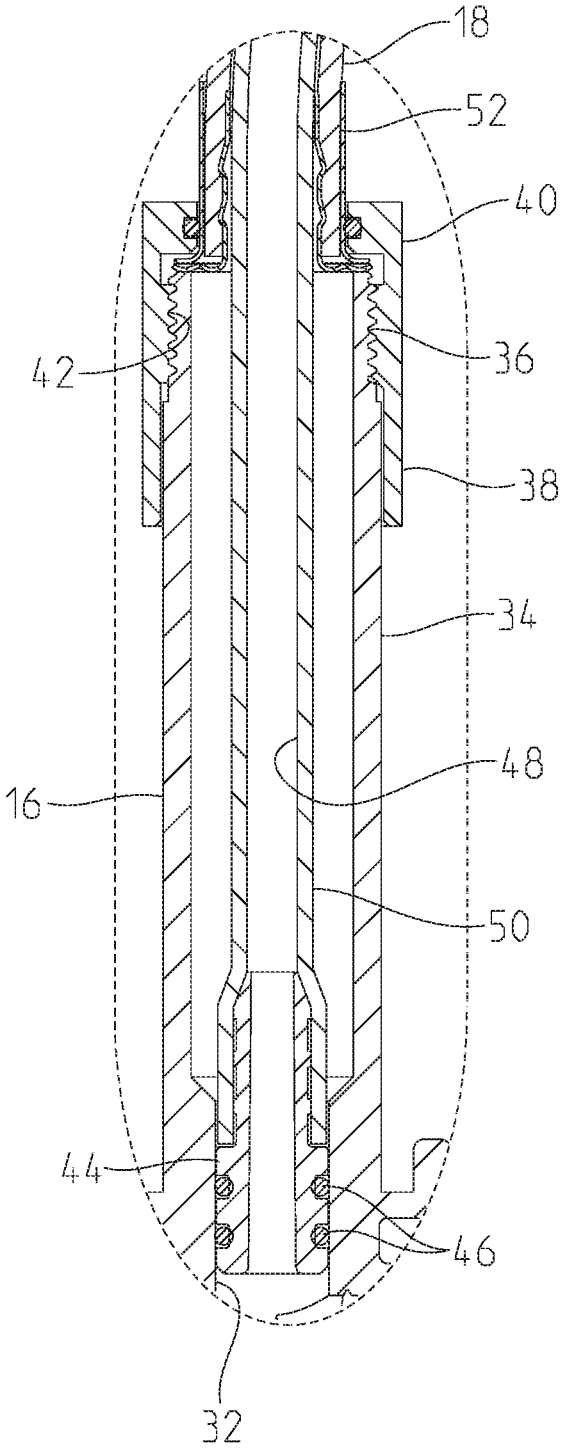
FIG. 3 is a detail view of a first fluid coupling between an outlet of a base of the shower head assembly and an inlet of flexible tubing of the shower head assembly within line 3 of FIG. 2.

Referring now to FIGS. 2 and 3, the base 16 includes an inlet 28 that receives water from the shower head pipe 14 (FIG. 1). Illustratively, the inlet 28 includes a threaded internal surface 30 that is coupled to a threaded external surface (not shown) of the shower head pipe 14. The inlet 28 is fluidly coupled to and delivers water to a passageway 32, and the passageway 32 is fluidly coupled to and delivers water to an outlet 34. The outlet 34 delivers water to the flexible tubing 18. Illustratively, the outlet 34 includes a threaded external surface 36 that is coupled to the flexible tubing 18.

With continued reference to FIGS. 2 and 3, the flexible tubing 18 includes an inlet 38 that couples to and receives water from the outlet 34 of the base 16. Illustratively, the inlet 38 includes a coupling 40 having a threaded internal surface 42 that is coupled to the threaded external surface 36 of the outlet 34 of the base 16. The inlet 38 also includes a fitting 44 that extends beyond the coupling 40 and is received in the outlet 34 of the base 16. The fitting 44 externally carries one or more seals (illustratively, O-rings 46) that engage the base 16. The fitting 44 is fluidly coupled to and delivers water to a passageway 48. Illustratively, the passageway 48 is defined within an inner tubing layer 50, which is generally disposed within an outer tubing layer 52. In alternative embodiments, other arrangements are possible. For example, in other illustrative embodiments, the flexible tubing 18 may include a single layer.

Figure 4:
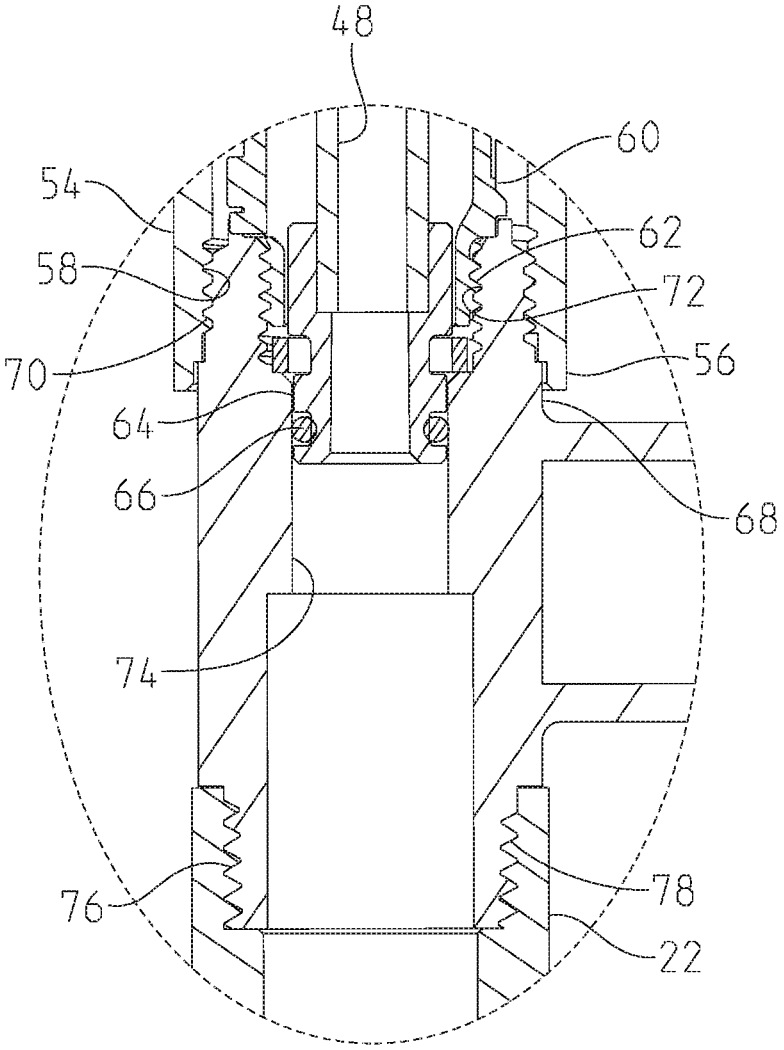
FIG. 4 is a detail view of a second fluid coupling between an outlet of the flexible tubing of the shower head assembly and an inlet of a neck of the shower head assembly within line 4 of FIG. 2.

Referring now to FIGS. 2 and 4, the passageway 48 of the flexible tubing 18 is fluidly coupled to and delivers water to an outlet 54. The outlet 54 delivers water to the neck 20. Illustratively, the outlet 54 includes an outer coupling 56 having a threaded internal surface 58 that is coupled to the neck 20 and an inner coupling 60 having a threaded external surface 62 that is coupled to the neck 20. The outlet 54 further includes a fitting 64 that is received in the neck 20. The fitting 64 externally carries one or more seals (illustratively, O-rings 66) that engage the neck 20.

With continued reference to reference to FIGS. 2 and 4, the coupling portion 26 of the neck 20 includes an inlet 68 that is coupled to and receives water from the outlet 54 of the flexible tubing 18. Illustratively, the inlet 68 includes a threaded external surface 70 that is coupled to the threaded internal surface 58 of the outer coupling 56 of the outlet 54 of the flexible tubing 18. The inlet 68 also includes a threaded internal surface 72 that is coupled to the threaded external surface 62 of the inner coupling 60 of the outlet 54 of the flexible tubing 18. The inlet 68 also receives the fitting 64 of the outlet 54 of the flexible tubing 18. The inlet 68 of the neck 20 is fluidly coupled to and delivers water to a passageway 74, and the passageway 74 is fluidly coupled to and delivers water to an outlet 76. The outlet 76 of the neck 20 delivers water to the shower head spout 22. Illustratively, the outlet 76 of the neck 20 includes a threaded external surface 78 that is coupled to the shower head spout 22.

Referring again to FIG. 2, the shower head spout 22 includes an inlet 80 that is coupled to and receives water from the outlet 76 of the neck 20. Illustratively, the inlet 80 of the shower head spout 22 includes a threaded internal surface 82 that is coupled to the threaded external surface 78 of the outlet 76 of the neck 20. The inlet 80 of the shower head spout 22 is fluidly coupled to and delivers water to a passageway 84, which in turn is fluidly coupled to and delivers water to an outlet 86 of the shower head spout 22. The outlet 86 of the shower head spout 22 discharges water from the shower head assembly 10. Illustratively, the shower head spout 22 includes a ball-and-socket joint 88 (that is, a joint permitting rotation about three axis) that facilitates repositioning the shower head spout 22. In alternative embodiments, other arrangements are possible. For example, in other illustrative embodiments, the shower head spout 22 may have various other components or styles, provided that the shower head spout 22 is capable of coupling to the neck 20 or coupling to an adapter (not shown) that is capable of coupling to the neck 20. Similarly, in some embodiments the shower head assembly 10 facilitates interchangeability of various shower head spouts having different components and/or styles.

Referring now to FIGS. 2 and 5-7 and as described briefly above, the base 16 also couples to the neck 20. Specifically, an elongated adjustment portion 90 of the neck 20 coupled to the coupling portion 26 of the neck 20 extends through an upper aperture 92 and a lower aperture 94 formed on the base 16. An arm portion 95 extends between the adjustment portion 90 and the coupling portion 26 of the neck 20. The arm portion 95 and the adjustment portion 90 are illustratively fluidly sealed from the coupling portion 26 of the neck 20, and thereby the water is supplied through the inlet 28 to the flexible tubing 18. The flexible tubing 18 illustratively extends external to and above the coupling portion 26 of the neck 20. The securing mechanism 24 carried by the base 16 selectively secures the neck 20 to the base 16. The securing mechanism 24 also permits translation, and thereby height-adjustment, of the adjustment portion 90 of the neck 20 (and thereby the coupling portion 26 of the neck 20, the outlet 54 of the flexible tubing 18 and the shower head spout 22) relative to the base 16 and the inlet 38 of the flexible tubing 18. Stated another way, the securing mechanism 24 is selectively reconfigurable from a first, or securing, configuration (see FIGS. 5 and 6) to a second, or adjustment, configuration (not shown) and vice versa. In the securing configuration, the securing mechanism 24 inhibits the neck 20 and the shower head spout 22 from translating relative to the base 16. In the adjustment configuration, the securing mechanism 24 permits the neck 20 and the shower head spout 22 to translate relative to the base 16.

Figure 5:
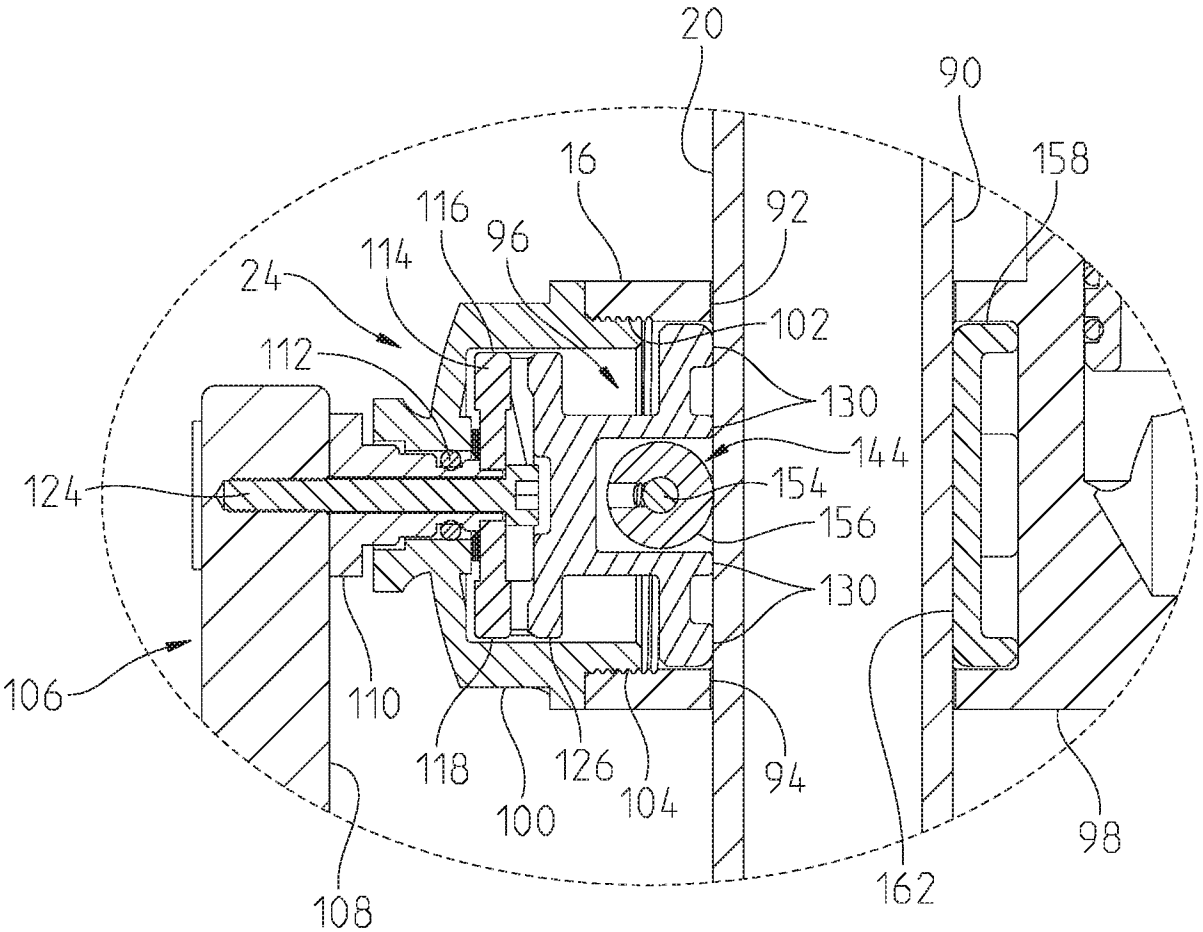
FIG. 5 is a detail view of a securing mechanism of the shower head assembly within line 5 of FIG. 2.
Figure 6:
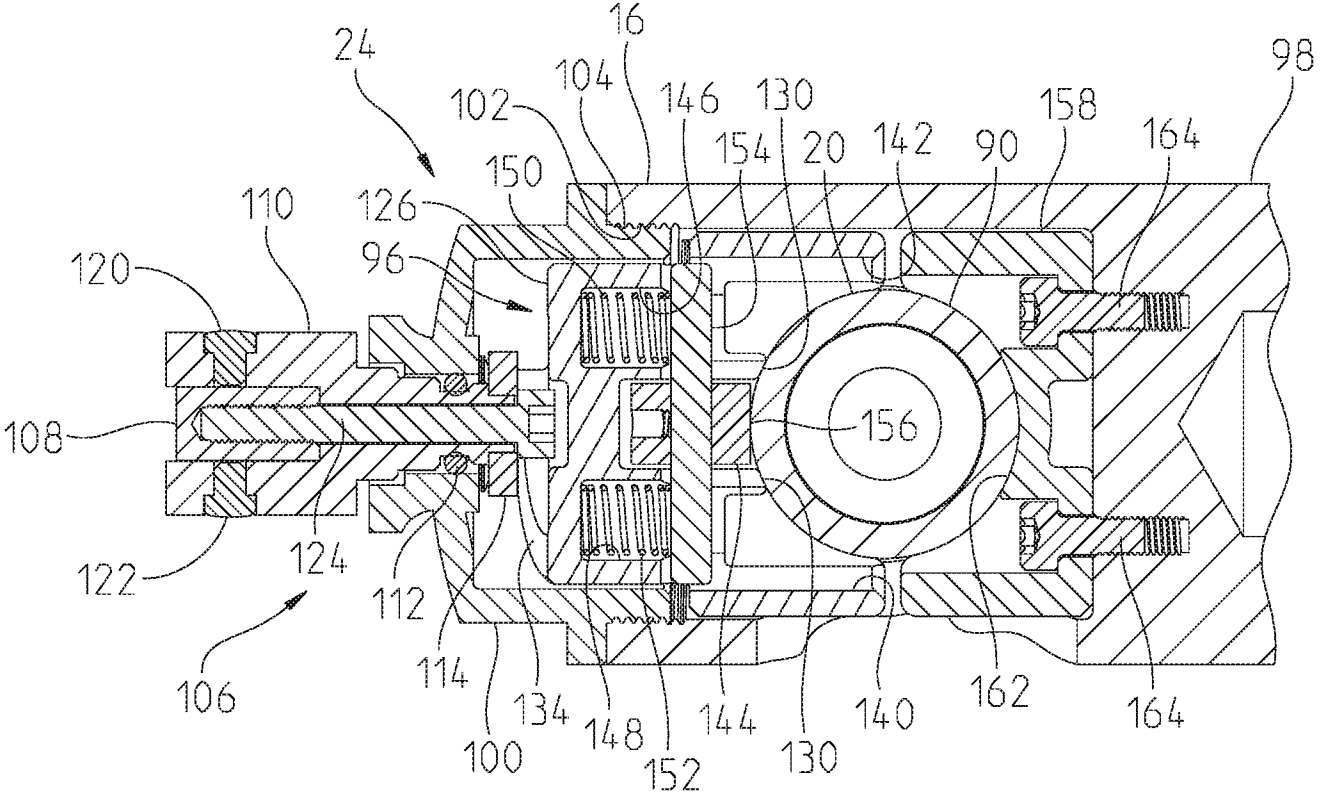
FIG. 6 is a top cross-sectional view of the securing mechanism of the shower head assembly take along line 6-6 of FIG. 1.
Figure 7:
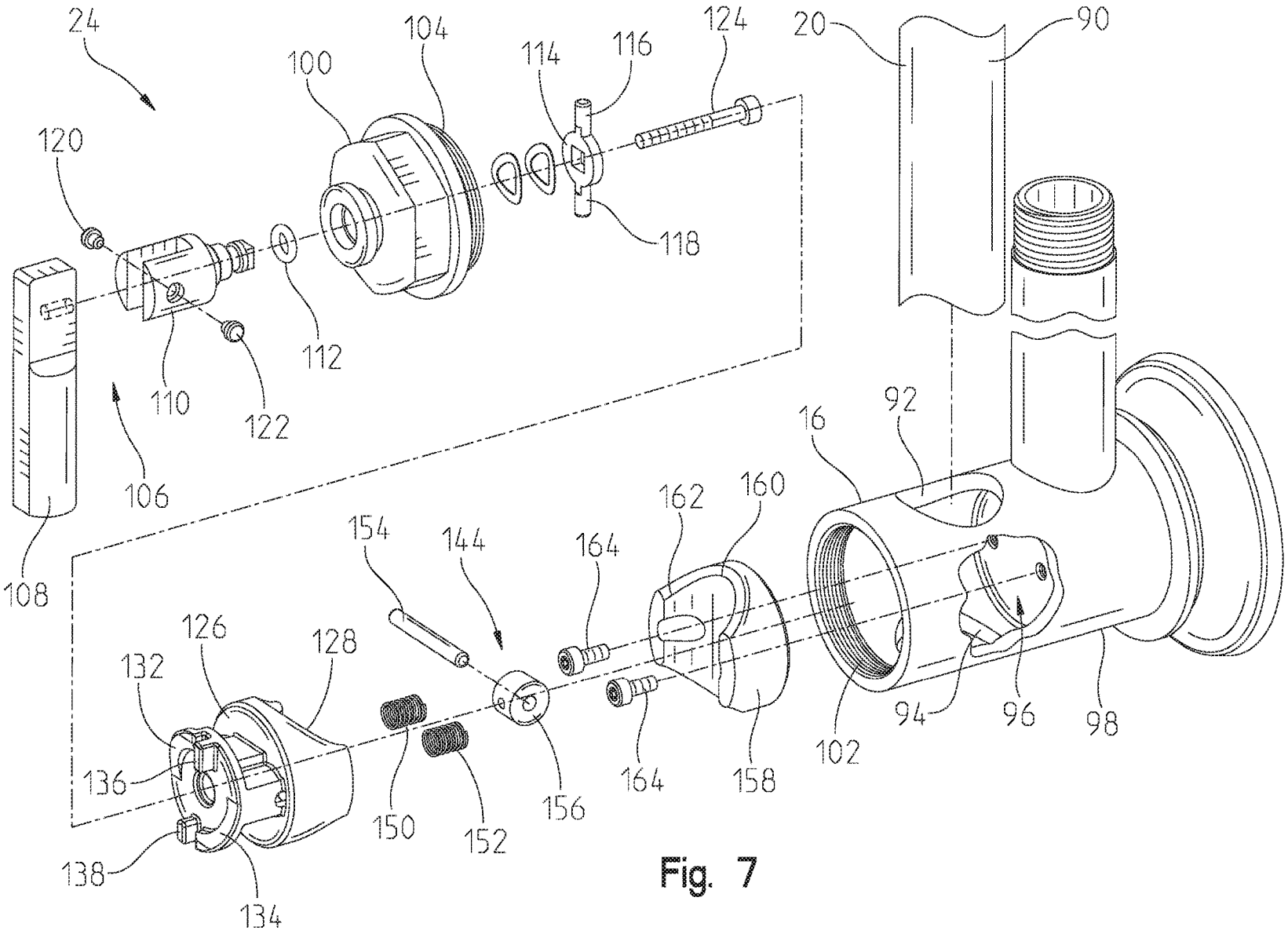
FIG. 7 is an exploded perspective view of the base and the neck of the shower head assembly of FIG. 1.

Referring specifically to FIGS. 5-7, the securing mechanism 24 is carried, in part, within a chamber 96 formed by a main body 98 and a detachable cover 100 (detachable via, for example, threaded surfaces 102 and 104) of the base 16. The securing mechanism 24 includes a handle 106 that is disposed outside of the chamber 96 and proximate the cover 100. The handle 106 may be manipulated by a user to reconfigure the securing mechanism 24 from the securing configuration to the adjustment configuration. Illustratively, the handle 106 may be rotated relative to the base 16 (for example, by about 90 degrees) to reconfigure the securing mechanism 24 from the securing configuration to the adjustment configuration. Illustratively, the handle 106 includes an elongated rod 108 that couples to a shaft 110. In alternative embodiments, other arrangements are possible. For example, in other illustrative embodiments, the handle 106 may include a generally circular knob (shown elsewhere). The shaft 110 carries a seal (illustratively, an O-ring 112), and the shaft 110 is pivotably carried by the cover 100. The shaft 110 also carries an arm element 114, and the arm element 114 pivots with the shaft 110 relative to the base 16. The arm element 114 illustratively includes a first arm 116 and a second arm 118 that extend away from the axis of the shaft 110. In alternative embodiments, the arm element 114 may include only one arm or additional arms. The arm element 114, the shaft 110, and the elongated arm are secured to each other by fasteners 120, 122, and 124.

Figure 8A:
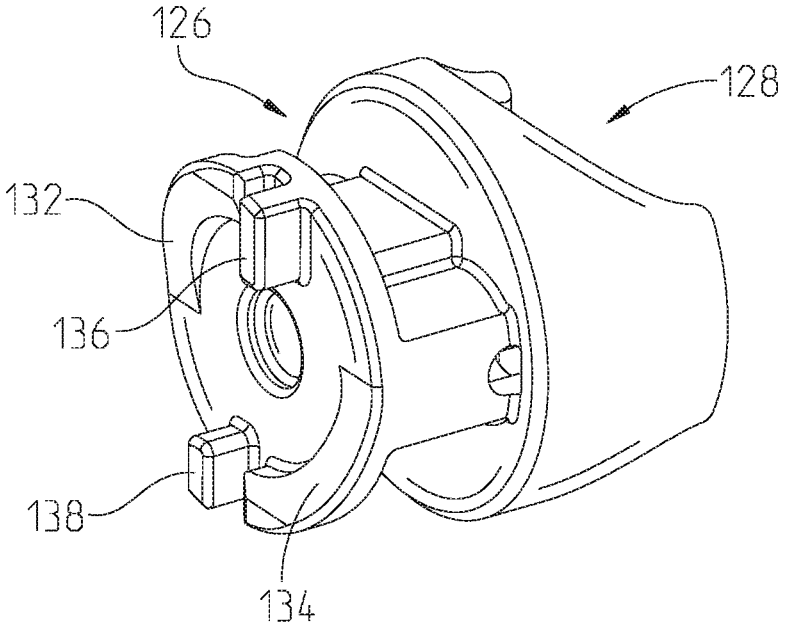
FIG. 8A is a front perspective view of a first securing element of the shower head assembly of FIG. 1.
Figure 8B:
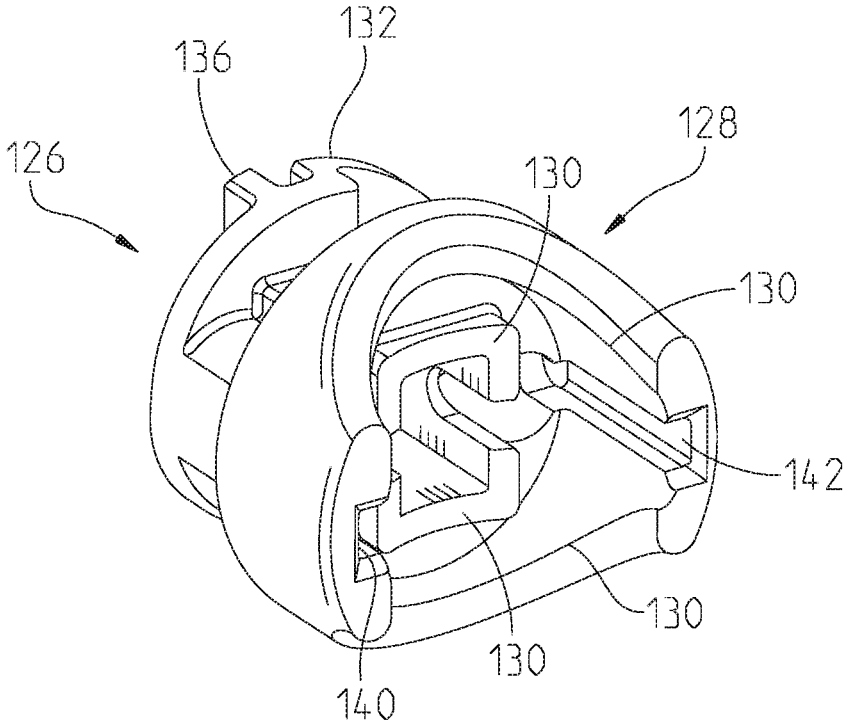
FIG. 8B is a rear perspective view of a first securing element of the shower head assembly of FIG. 1.

With continued reference to FIGS. 5-7 and additional reference to FIGS. 8A and 8B, the securing mechanism 24 further includes a first securing element 126 that is selectively engagable with the neck 20 to inhibit the neck 20 and the shower head spout 22 from translating relative to the base 16. Stated another way, in the securing configuration, the first securing element 126 engages the neck 20 to inhibit the neck 20 and the shower head spout 22 from translating relative to the base 16. In the adjustment configuration, the first securing element 126 disengages the neck 20 to permit the neck 20 and the shower head spout 22 to translate relative to the base 16. Illustratively, the first securing element 126 includes a curved channel 128 and curved engagement surfaces 130 for engaging the neck 20. In alternative embodiments, the first securing element 126 may include other engagement features. For example, in other illustrative embodiments, the first securing element 126 may include one or more flat engagement surfaces. The first securing element 126 may comprise various materials. Illustratively, the first securing element 126 comprises one or more plastic materials that provide relatively high friction with the neck 20, such as synthetic rubbers (for example, styrenic block copolymers), natural rubbers, or the like.

Opposite the engagement features, the first securing element 126 illustratively includes a first ramp 132 and a second ramp 134 that facilitate reconfiguring the first securing element 126 from the securing configuration to the adjustment configuration and vice versa. That is, the first ramp 132 and the second ramp 134 engage the first arm 116 and the second arm 118, respectively, of the arm element 114, and the first arm 116 and the second arm 118 slide along the first ramp 132 and the second ramp 134, respectively, as the handle 106 and the arm element 114 pivot relative to the base 16. When reconfiguring the securing mechanism 24 from the adjustment configuration to the securing configuration, the arms 116 and 118 slide along and push the ramps 132 and 134, respectively, away from the handle 106, which moves the first securing element 126 into engagement with the neck 20. When reconfiguring the securing mechanism 24 from the securing configuration to the adjustment configuration, the arms 116 and 118 slide along and permit the ramps 132 and 134, respectively, to move toward the handle 106 (due to the presence of biasing elements, as described below), which disengages the first securing element 126 from the neck 20. The first securing element 126 also illustratively includes a first stop 136 and a second stop 138 that engage the first arm 116 and the second arm 118, respectively, to limit pivoting movement of the arm element 114 and the handle 106 relative to the base 16. In alternative embodiments, other arrangements are possible. For example, in other illustrative embodiments, the first securing element 126 may include only one ramp and only one stop (for example, if the arm element 114 includes only one arm).

The first securing element 126 illustratively includes a first slot 140 and a second slot 142 that translatably receive a roller device 144. The first securing element 126 also illustratively includes a first recess 146 and a second recess 148 that receive a first biasing element and a second biasing element, respectively (for example, a first compression spring 150 and a second compression spring 152 compressed between the first securing element 126 and the roller device 144). The first biasing element and the second biasing element urge the roller device 144 into engagement with the neck 20 (in both the adjustment configuration and the securing configuration), and the roller device 144 rotates relative to the first securing element 126 as the neck 20 translates relative to the base 16 (in the adjustment configuration). Illustratively, the roller device 144 includes a roller pin 154 that couples to a roller wheel 156 (for example, via a set screw; not shown). In alternative embodiments, other arrangements are possible. For example, in other illustrative embodiments, the roller pin 154 and the roller wheel 156 may be monolithically formed.

Referring again to FIGS. 5-7, the roller device 144 urges the neck 20 into engagement with a second securing element 158 opposite the roller device 144 and the first securing element 126. The second securing element 158 illustratively includes a curved channel 160 having a curved engagement surface 162 for engaging the neck 20. Illustratively, the second securing element 158 couples to the main body 98 of the base 16 via fasteners 164. The second securing element 158 may comprise various materials. Illustratively, the second securing element 158 comprises one or more plastic materials that provide relatively high friction with the neck 20, such as synthetic rubbers (for example, styrenic block copolymers), natural rubbers, or the like.

In the securing configuration, the first securing element 126, the roller device 144, and the second securing element 158 compressively engage the neck 20 therebetween to inhibit the neck 20 and shower head spout 22 from moving relative to the base 16. In the adjustment configuration, the roller device 144 and the second securing element 158 compressively engage the neck 20 therebetween. As a result, in the adjustment configuration the second securing element 158 applies friction forces to the neck 20 that inhibit movement of the neck 20 and shower head spout 22 relative to the base 16. In the adjustment configuration, these friction forces, among other forces, provide resistance and inhibit movement of the neck 20 and shower head spout 22 relative to the base 16. Illustratively, the resistance forces are sufficient to keep the neck 20 and shower head spout 22 from moving relative to the base 16 due to component weights (for example, the weight of the neck 20 and the shower head spout 22). However, the resistance forces may be overcome by a user applying an external force to the neck 20 and/or the shower head spout 22, and the neck 20 and shower head spout 22 thereby translate relative to the base 16. More generally, in the adjustment configuration the neck 20 and shower head spout 22 translate relative to the base 16 when movement forces are greater than resistance forces, as shown in equation 1.

$$F_m > F_r \tag{1}$$

where:

$F_m$ are movement forces; and $F_r$ are resistance forces.

When the external force is applied in a downward direction (that is, at least a component of the external force is in the downward direction), the movement forces and resistance forces are as shown in equation 2 and equation 3, respectively.

$$F_m = F_e + W_n + W_s + W_{pt} + W_{pw} \tag{2}$$

where:

$F_e$ is the external force applied by the user;

$W_n$ is the weight of the neck 20;

$W_s$ is the weight of the shower head spout 22;

$W_{pt}$ is the portion of the weight of the flexible tubing 18 that is carried through the neck 20 and the securing mechanism 24; and $W_{pt}$ is the portion of the weight of any water in the shower head assembly 10 that is carried through the neck 20 and the securing mechanism 24.

$$F_r = F_f + F_t \tag{3}$$

where:

$F_f$ are friction forces, such as friction forces due to resistance of relative movement of the neck 20 and the second securing element 158 and resistance of relative movement of the roller pin 154 and the first securing element 126; and $F_t$ are reconfiguration forces provided by the flexible tubing 18 due to resistance to shape changes caused by relative movement of the inlet 38 and outlet 54 thereof (due to movement of the neck 20 and shower head spout 22 relative to the base 16).

When the external force is applied in an upward direction (that is, at least a component of the external force is in the upward direction), the movement forces and resistance forces are as shown in equation 4 and equation 5, respectively.

$$F_m = F_e \tag{4}$$

$$F_r = F_f + F_t + W_n + W_s + W_{pt} + W_{pw} \tag{5}$$

In alternative embodiments, other arrangements of the securing mechanism 24 are possible. For example, the shaft 110, the arm element 114, and the first securing element 126 could be replaced by a flat-tipped screw (not shown) that is rotated to selectively engage the neck 20 and inhibit movement of the neck 20 and the shower head spout 22 relative to the base 16.

Figure 9:
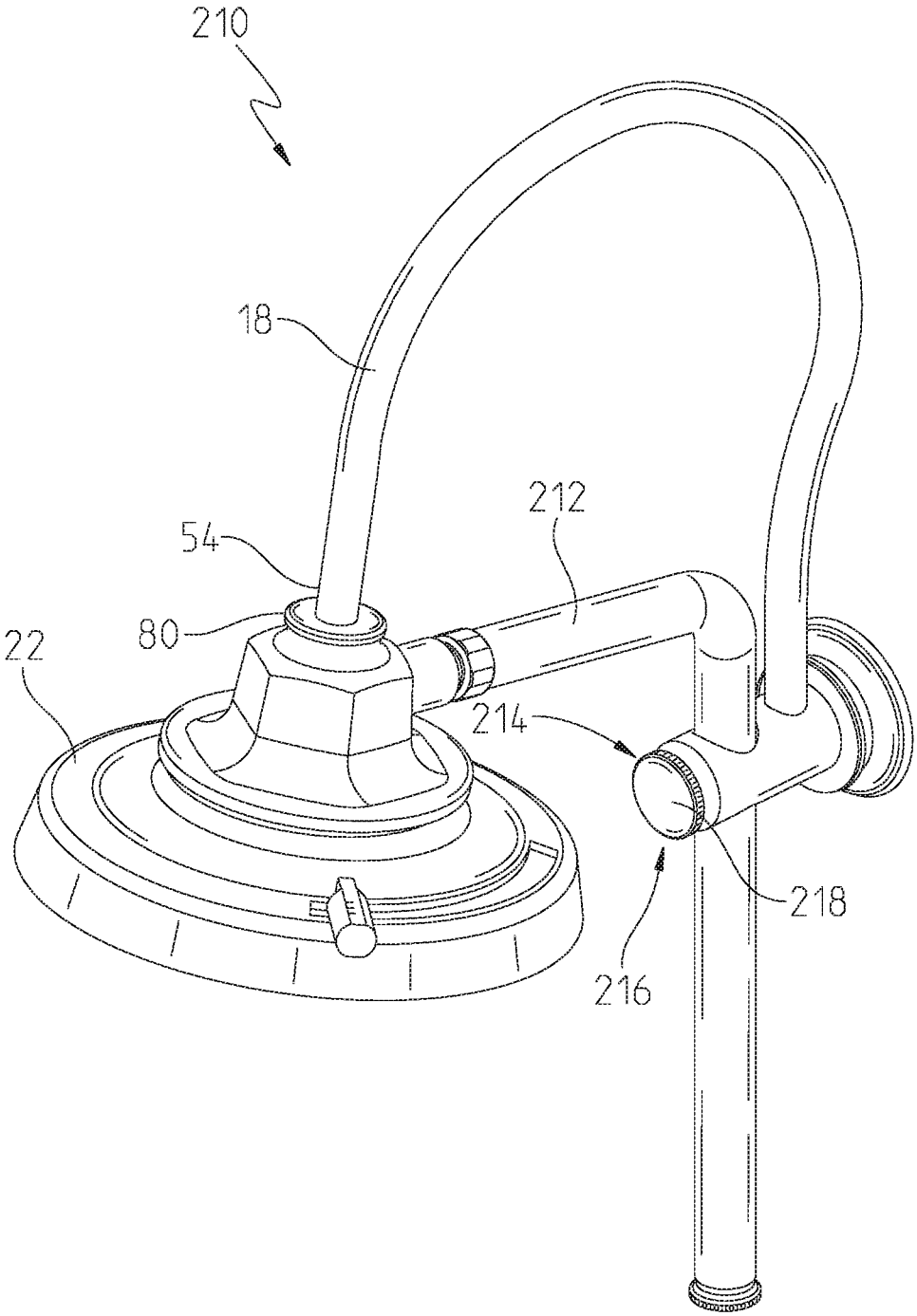
FIG. 9 is a perspective view of another illustrative shower head assembly of the present disclosure.

In alternative embodiments, other arrangements of shower head assemblies are possible. For example and referring to FIG. 9, another illustrative shower head assembly 210 is shown. The shower head assembly 210 illustratively includes the same components as the shower head assembly 10, except that the neck 212 lacks a coupling portion, and water does not flow through the neck 212. Instead, the outlet 54 of the flexible tubing 18 directly couples to the inlet 80 of the shower head spout 22, and the flexible tubing 18 thereby directly delivers water to the shower head spout 22. Further, the handle 214 of the securing mechanism 216 includes a generally circular rotatable knob 218. In another illustrative alternative embodiment, the base 16 couples to the building structure, but does not couple to or receive water from the shower head pipe 14. Instead, the flexible tubing 18 directly couples to and receives water from the shower head pipe 14.

As another example and referring to FIGS. 10-15, another illustrative shower head assembly 310 is shown. The shower head assembly 310 includes many similar components as the shower head assembly 10, where similar components are identified with like reference numbers.

Figure 10:
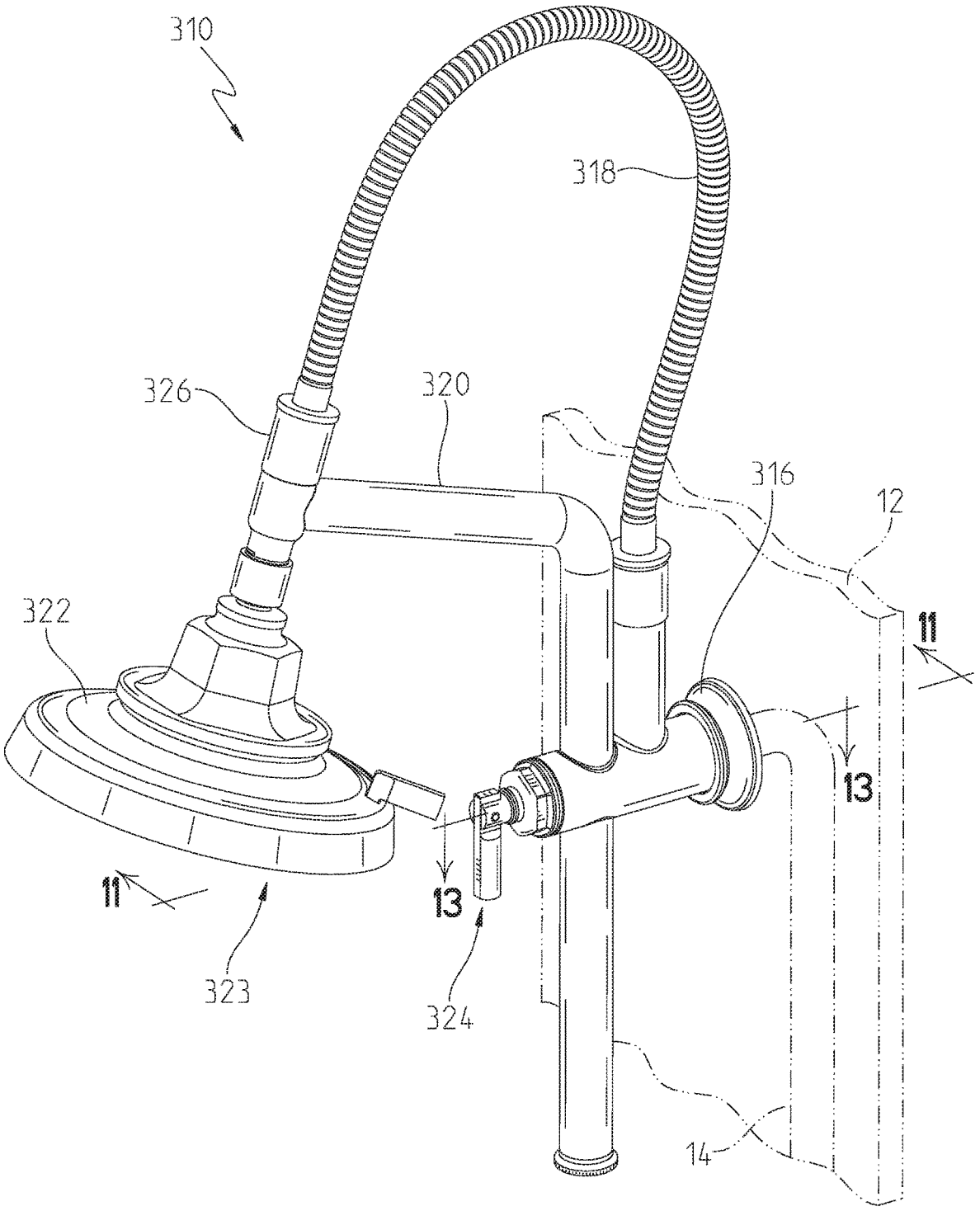
FIG. 10 is a perspective view of yet another illustrative shower head assembly of the present disclosure mounted to a wall and a shower head pipe.
Figure 11:
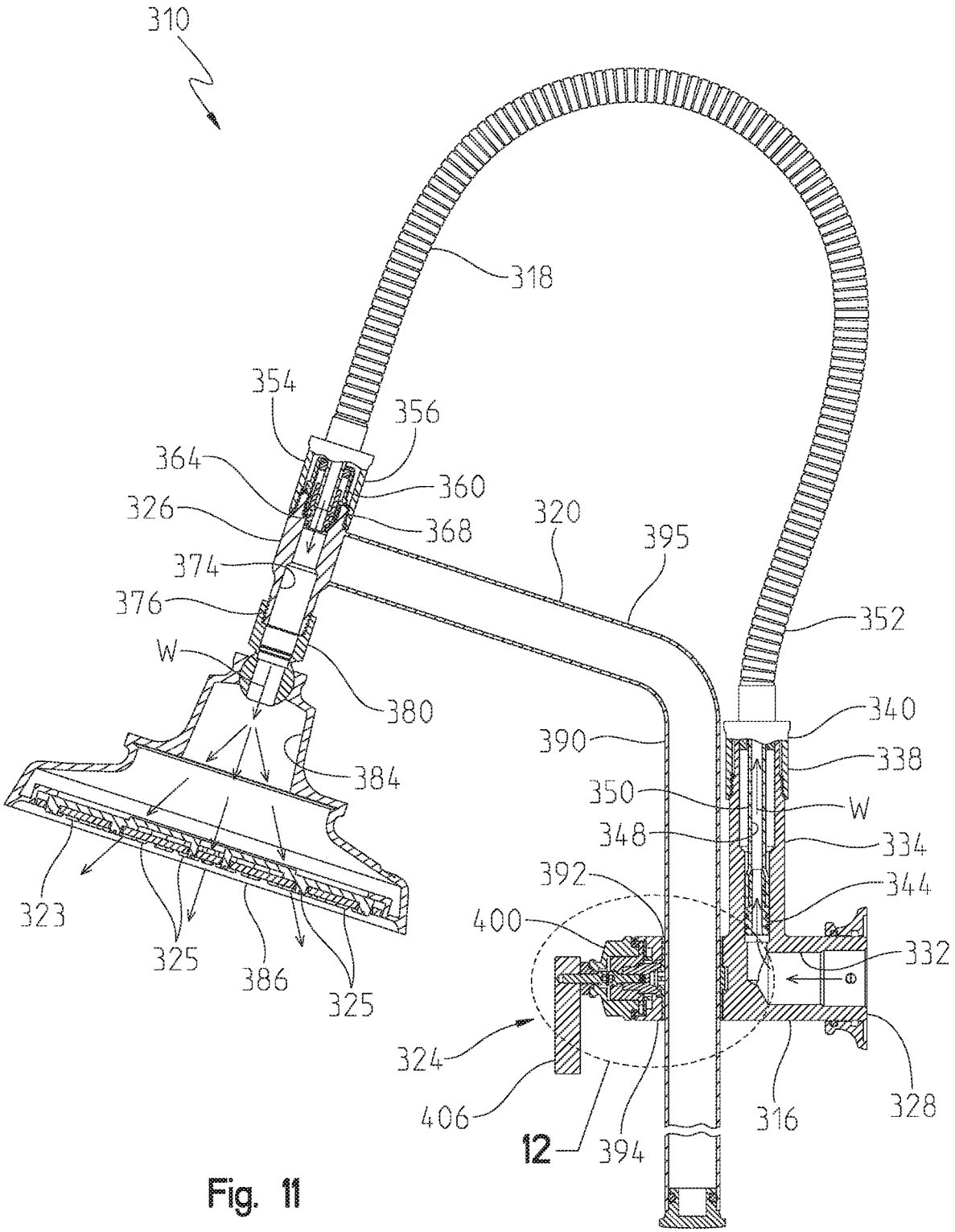
FIG. 11 is a partial side cross-sectional view of the shower head assembly taken along line 11-11 of FIG. 10.

As shown in FIGS. 10 and 11, the shower head assembly 310 is shown coupled to a building structure (illustratively, a wall 12) and a shower head pipe or riser 14. The shower head pipe 14 delivers water to the shower head assembly 310. Generally, the shower head assembly 310 includes a base 316 that couples to and receives water from the shower head pipe 14. The base 316 couples to and delivers water to exposed flexible tubing 318 (that is, tubing that is not carried within any other component of the shower head assembly 310). The flexible tubing 318 couples to and delivers water to a neck 320, which in turn couples to and delivers water to a shower head spout or spray head 322. The shower head spout 322 discharges water from the shower head assembly 310. More particularly, the shower head spout 322 includes a sprayface 323, and sprayface 323 includes a plurality of outlets 325 (for example, nozzles) to discharge water. The base 316 also couples to the neck 320, and a securing mechanism 324 carried by the base 316 facilitates selectively securing and permitting translation of the neck 320 relative to the base 316. As a result, the neck 320 and the shower head spout 322 are height-adjustable (that is, movable in a vertical direction relative to a shower basin), and the flexible tubing 318 facilitates water delivery from the base 316 to the shower head spout 322 at various heights of the shower head spout 322. These and other features of shower head assembly 310 are described further in the following paragraphs.

FIG. 11 is a side sectional view of the shower head assembly 310 that illustrates the path of water W through the shower head assembly 310. The path of water W through the shower head assembly 310 is similar to the path of water W through the shower head assembly 10. That is, generally, water flows from the base 316 through the flexible tubing 318, through a coupling portion 326 of the neck 320, to the shower head spout 322, and the shower head spout 322 discharges water from the shower head assembly 10. Further, the base 316, the flexible tubing 318, the neck 320, and the shower head spout 322 couple to each other in similar manners as in the shower head assembly 10. That is, generally, the base 316 includes an inlet 328 that receives water from the shower head pipe 314 (FIG. 10). The inlet 328 is fluidly coupled to and delivers water to a passageway 332, and the passageway 332 is fluidly coupled to and delivers water to an outlet 334. The outlet 334 delivers water to the flexible tubing 318. The flexible tubing 318 includes an inlet 338 that couples to and receives water from the outlet 334 of the base 316. The inlet 338 includes a fitting 344 that extends beyond a coupling 340 and is received in the outlet 334 of the base 316. The fitting 344 is fluidly coupled to and delivers water to a passageway 348. Illustratively, the passageway 348 is defined within an inner tubing layer 350, which is generally disposed within an outer tubing layer 352. In alternative embodiments, other arrangements are possible. For example, in other illustrative embodiments, the flexible tubing 318 may include a single layer. The passageway 348 of the flexible tubing 318 is fluidly coupled to and delivers water to an outlet 354. The outlet 354 delivers water to the neck 320.

Illustratively, the outlet 354 includes an outer coupling 356 and an inner coupling 360 that are coupled to the neck 320. The outlet 354 further includes a fitting 364 that is received in the neck 320. The coupling portion 326 of the neck 320 includes an inlet 368 that is coupled to and receives water from the outlet 354 of the flexible tubing 318. The inlet 368 couples to the outer coupling 356, the inner coupling 360, and the fitting 364 of the outlet 354 of the flexible tubing 318. The inlet 368 of the neck 320 is fluidly coupled to and delivers water to a passageway 374, and the passageway 374 is fluidly coupled to and delivers water to an outlet 376. The outlet 376 of the neck 320 delivers water to the shower head spout 322. The shower head spout 322 includes an inlet 380 that is coupled to and receives water from the outlet 376 of the neck 320. The inlet 380 of the shower head spout 322 is fluidly coupled to and delivers water to a passageway 384, which in turn is fluidly coupled to and delivers water to an outlet 386 of the shower head spout 322. The outlet 386 of the shower head spout 322 discharges water from the shower head assembly 310.

Referring now to FIGS. 11-15, and as described briefly above, the base 316 also couples to the neck 320. Specifically, an elongated adjustment portion 390 of the neck 320 coupled to the coupling portion 326 of the neck 320 extends through an upper aperture 392 and a lower aperture 394 formed on the base 316. An arm portion 395 extends between the adjustment portion 390 and the coupling portion 326 of the neck 320. The arm portion 395 and the adjustment portion 390 are illustratively fluidly sealed from the coupling portion 326 of the neck 320, and thereby the water is supplied through the inlet 328 to the flexible tubing 318. The flexible tubing 318 illustratively extends external to and above the coupling portion 326 of the neck 320. The securing mechanism 324 carried by the base 316 selectively secures the neck 320 to the base 316. The securing mechanism 324 also permits translation, and thereby height-adjustment, of the adjustment portion 390 of the neck 320 (and thereby the coupling portion 326 of the neck 320, the outlet 354 of the flexible tubing 318 and the shower head spout 322) relative to the base 316 and the inlet 338 of the flexible tubing 318. Stated another way, the securing mechanism 324 is selectively reconfigurable from a first, or securing, configuration (as illustrated) to a second, or adjustment, configuration (not shown) and vice versa. In the securing configuration, the securing mechanism 324 inhibits the neck 320 and the shower head spout 322 from translating relative to the base 316. In the adjustment configuration, the securing mechanism 324 permits the neck 320 and the shower head spout 322 to translate relative to the base 316. The securing mechanism 324 is carried, in part, within a chamber 396 formed by a main body 398 and a detachable cover 400. The securing mechanism 324 includes a handle 406 that is disposed outside of the chamber 396 and proximate the cover 400. The handle 406 may be manipulated by a user to reconfigure the securing mechanism 324 from the securing configuration to the adjustment configuration. Illustratively, the handle 406 may be rotated relative to the base 316 (for example, by about 90 degrees) to reconfigure the securing mechanism 324 from the securing configuration to the adjustment configuration. Illustratively, the handle 406 includes an elongated rod 408 that couples to a shaft 410. The elongated rod 408, the shaft 410, and cover 400 are secured to each other by fasteners 420, 422, and 424.

The cover 400 is detachably secured to a cover mounting element 466 carried within the chamber 396. Illustratively, the cover 400 press-fittingly engages the cover mounting element 466 (for example, by including a generally hexagonal recess 468 that receives a generally hexagonal mounting protrusion 470 of the cover mounting element 466) and is secured to the cover mounting element 466 via a set screw assembly 472. Accordingly, the cover 400, the shaft 410, the elongated rod 408, and the fasteners 420, 422, and 424 may be detached and replaced, for example, with similar components of different colors, styles, combinations thereof, and the like.

The cover mounting element 466 and the main body 398 include features that limit the rotational range of motion of the cover mounting element 466, and thereby the cover 400 and the handle 406, relative to the main body 398. Illustratively, the main body 398 includes a rib or protrusion 474 in the chamber 396 (see FIGS. 13 and 14) that is received in an arcuate slot 476 formed on the cover mounting element 466. Ends 478, 480 of the slot 476 engage the protrusion 474 to limit the rotational range of motion of the cover mounting element 466 relative to the main body 398 (for example, to substantially 90 degrees).

The cover mounting element 466 couples to a ramp element 482 opposite the cover 400. Illustratively, the cover mounting element 466 couples to the ramp element 482 via a fastener 484. Accordingly, the cover mounting element 466, the ramp element 482, the cover 400, the shaft 410, and the elongated rod 408 are rotatable together relative to the main body 398 of the base 316. Illustratively, the securing mechanism 324 includes a first washer 486 and a second washer 488 that inhibit wear between adjacent rotatable components. More specifically, the first washer 486 may be formed of one or more plastic materials, the cover 400 and the main body 398 may be formed of one or more metal materials, and the first washer 486 may inhibit wear between the cover 400 and the main body 398, and the second washer 488 may be formed of one or more plastic materials, the cover mounting element 466 and the main body 398 may be formed of one or more metal materials, and the second washer 488 may inhibit wear between the cover mounting element 466 and main body 398.

Opposite the cover mounting element 466, the ramp element 482 engages a securing device 490 that surrounds the adjustment portion 390 of the neck 320. The ramp element 482 rotates relative to the securing device 490 to facilitate further engaging the securing device 490 against the neck 320 (that is, reconfiguring the securing mechanism 324 to the securing configuration) and relatively disengaging the securing device 490 from the neck 320 (that is, reconfiguring the securing mechanism 324 to the adjustment configuration). The ramp element 482 includes a ramp portion 492 (illustratively, including a first ramp 494 and a second ramp 496) that engages a first securing element 498 (illustratively, including a first cantilevered arm 500 and a second cantilevered arm 502) of the securing device 490 to facilitate relatively engaging and disengaging the first securing element 498 from the neck 320. More specifically, when reconfiguring the securing mechanism 324 from the adjustment configuration to the securing configuration, the first ramp 494 and the second ramp 496 slide along and push the first cantilevered arm 500 and the second cantilevered arm 502, respectively, into further engagement with the neck 320. When reconfiguring the securing mechanism 324 from the securing configuration to the adjustment configuration, the first ramp 494 and the second ramp 496 slide along and permit the first cantilevered arm 500 and the second cantilevered arm 502, respectively, to relax and relatively disengage the neck 320.

In the securing configuration, the securing device 490 engages the neck 320 to inhibit the neck 320 and shower head spout 322 from moving relative to the base 316. In the adjustment configuration, the securing device 490 relatively disengages the neck 320, but nevertheless applies a torque to the neck 320 (to balance the weight of the shower head spout 322, the neck 320, and the flexible tubing 318, which is offset from the adjustment portion 390 of the neck 320). As a result, in the adjustment configuration the securing device 490 applies friction forces to the neck 320 that inhibit movement of the neck 320 and shower head spout 322 relative to the base 316. In the adjustment configuration, these friction forces, among other forces, provide resistance and inhibit movement of the neck 320 and shower head spout 322 relative to the base 316. Illustratively, the resistance forces are sufficient to keep the neck 320 and shower head spout 322 from moving relative to the base 316 due to component weights (for example, the weight of the neck 320 and the shower head spout 322). However, the resistance forces may be overcome by a user applying an external force to the neck 320 and/or the shower head spout 322, and the neck 320 and shower head spout 322 thereby translate relative to the base 316. More generally, in the adjustment configuration the neck 320 and shower head spout 322 translate relative to the base 316 when movement forces are greater than resistance forces, as shown in equation 6.

$$F_m > F_r \tag{6}$$

where:

$F_m$ are movement forces; and $F_r$ are resistance forces.

When the external force is applied in a downward direction (that is, at least a component of the external force is in the downward direction), the movement forces and resistance forces are as shown in equation 7 and equation 8, respectively.

$$F_m = F_e + W_n + W_s + W_{pt} + W_{pw} \tag{7}$$

where:

$F_e$ is the external force applied by the user;

$W_n$ is the weight of the neck 320;

$W_s$ is the weight of the shower head spout 322;

$W_{pt}$ is the portion of the weight of the flexible tubing 318 that is carried through the neck 320 and the securing mechanism 324; and $W_{pt}$ is the portion of the weight of any water in the shower head assembly 310 that is carried through the neck 320 and the securing mechanism 324.

$$F_r = F_f + F_t \tag{8}$$

where:

$F_f$ are friction forces, such as friction forces due to the torque applied by the securing device 490 to the neck 320; and $F_t$ are reconfiguration forces provided by the flexible tubing 318 due to resistance to shape changes caused by relative movement of the inlet 338 and outlet 354 thereof (due to movement of the neck 320 and shower head spout 322 relative to the base 316).

When the external force is applied in an upward direction (that is, at least a component of the external force is in the upward direction), the movement forces and resistance forces are as shown in equation 9 and equation 10, respectively.

$$F_m = F_e \tag{9}$$

$$F_r = F_f + F_t + W_n + W_s + W_{pt} + W_{pw} \tag{10}$$

Figure 12:
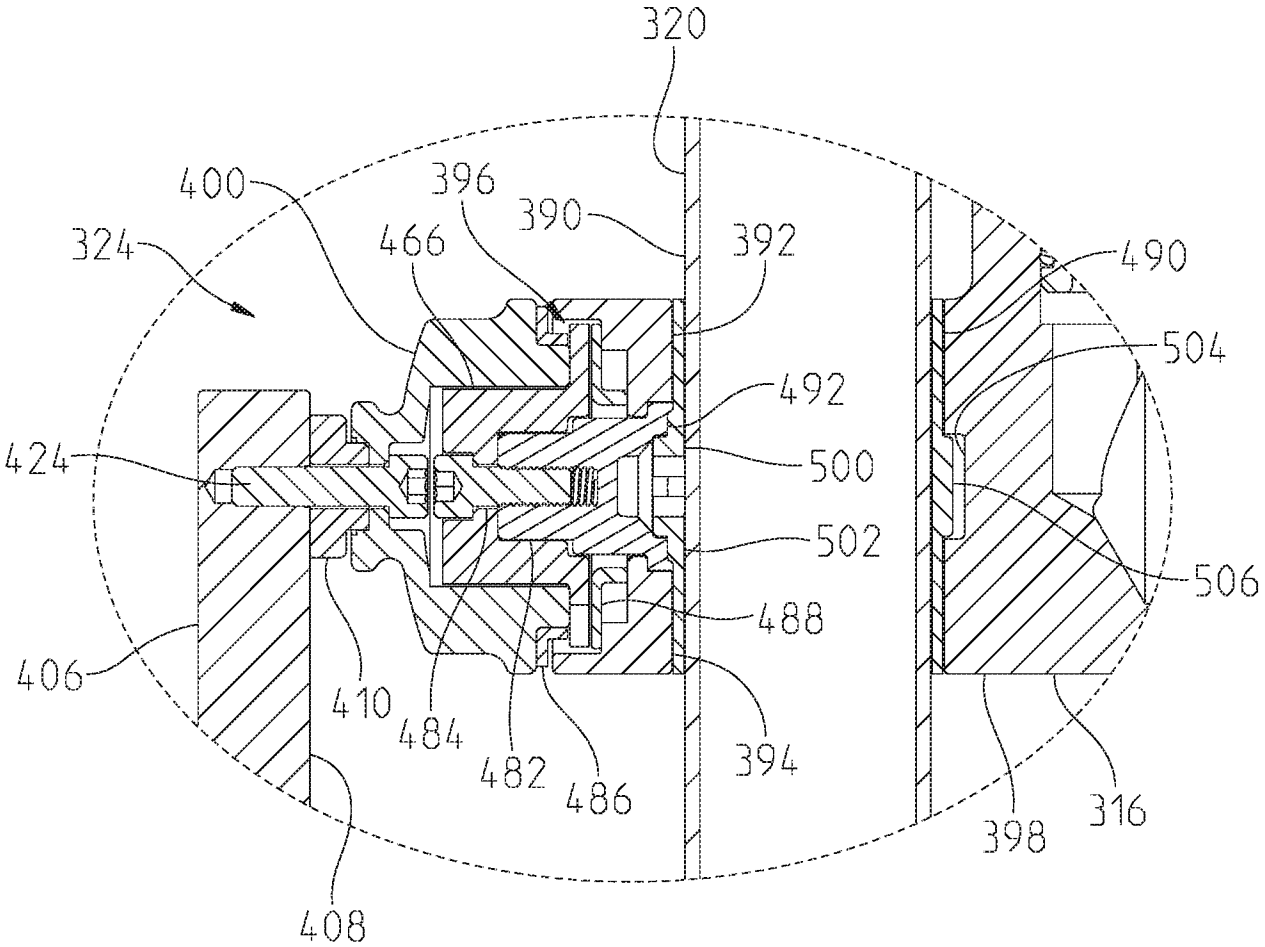
FIG. 12 is a detail view of a securing mechanism of the shower head assembly within line 12 of FIG. 11.
Figure 13:
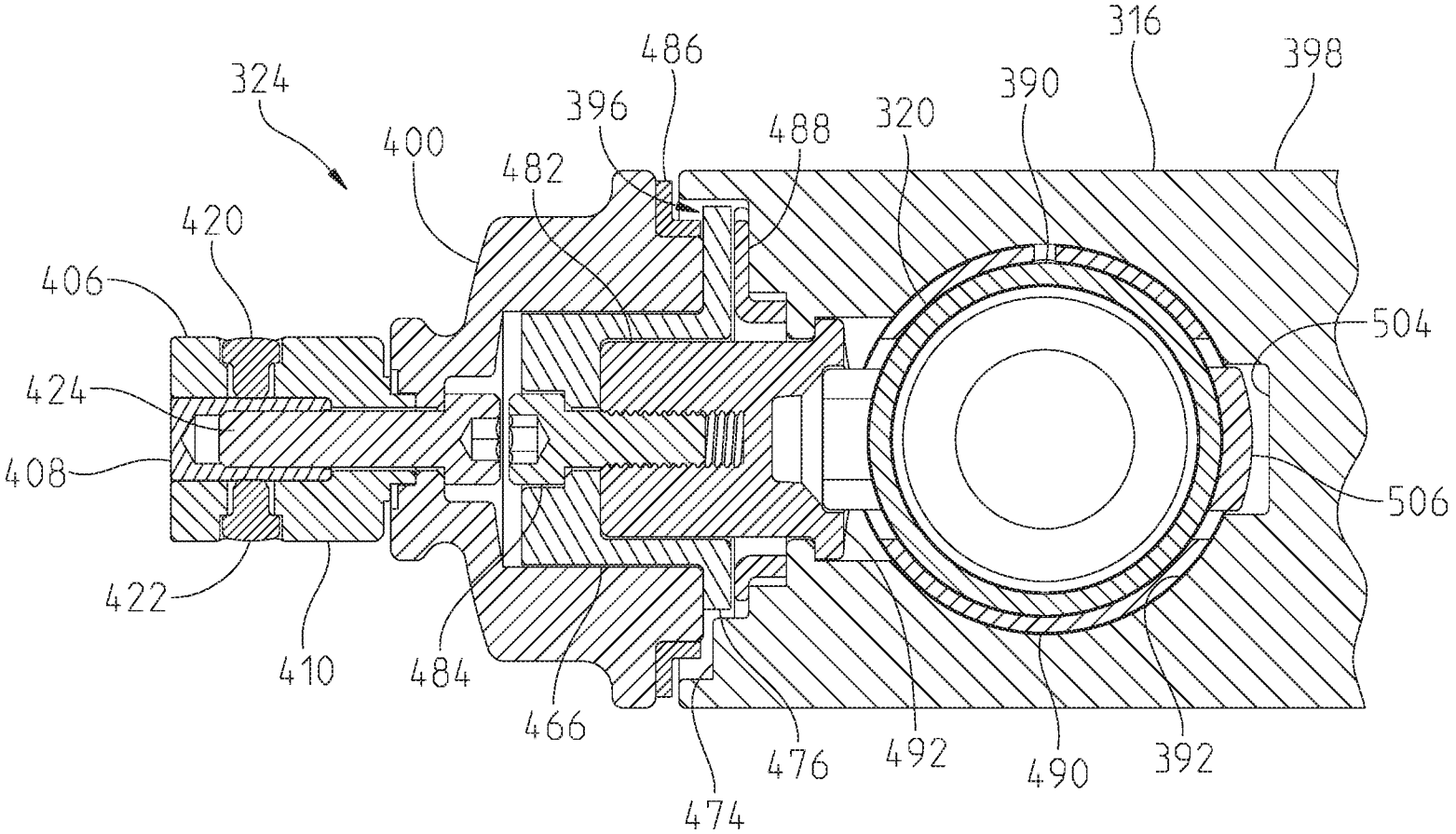
FIG. 13 is a top cross-sectional view of the securing mechanism of the shower head assembly take along line 13-13 of FIG. 10.
Figure 14:
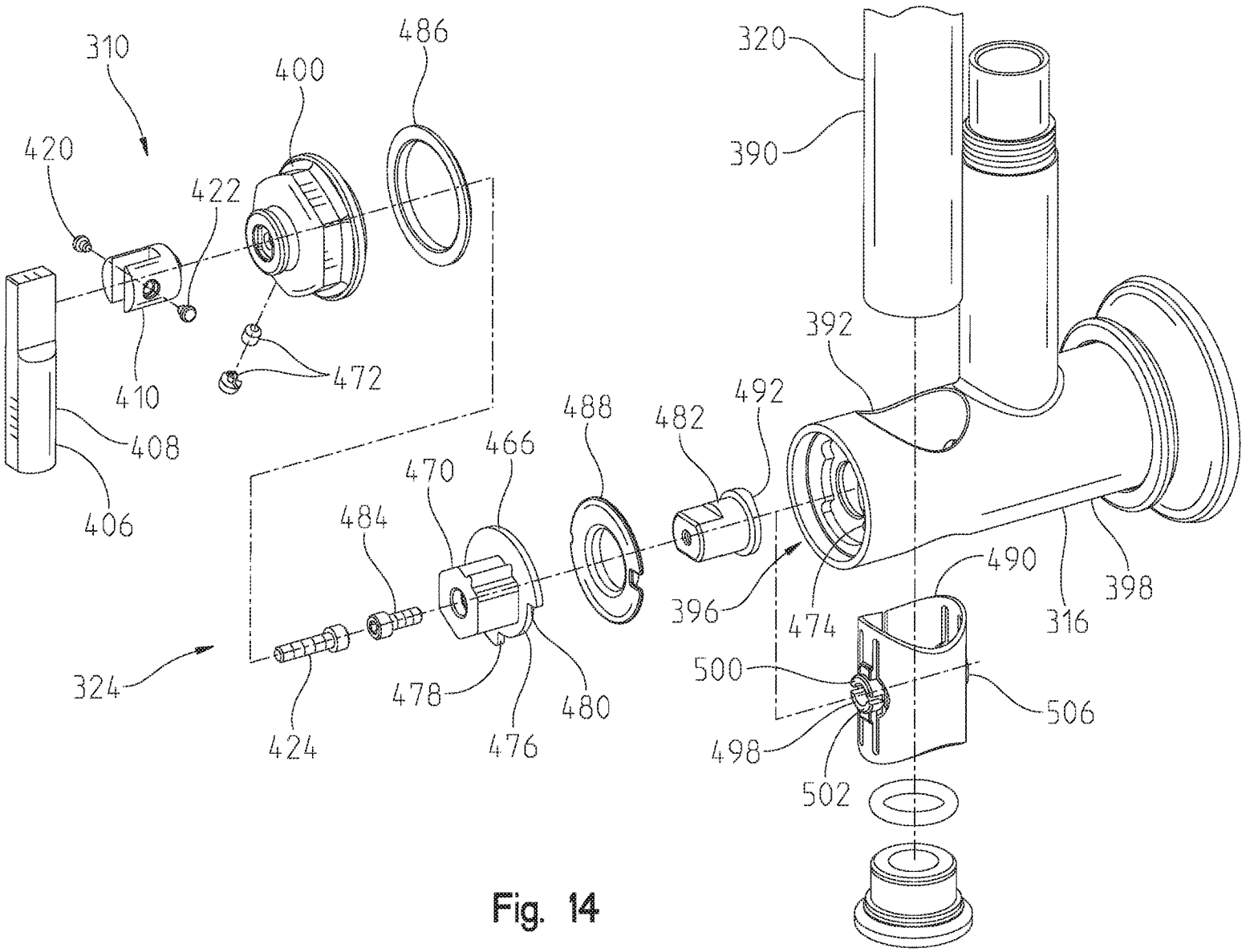
FIG. 14 is an exploded front perspective view of a base and a neck of the shower head assembly of FIG. 10.
Figure 15:
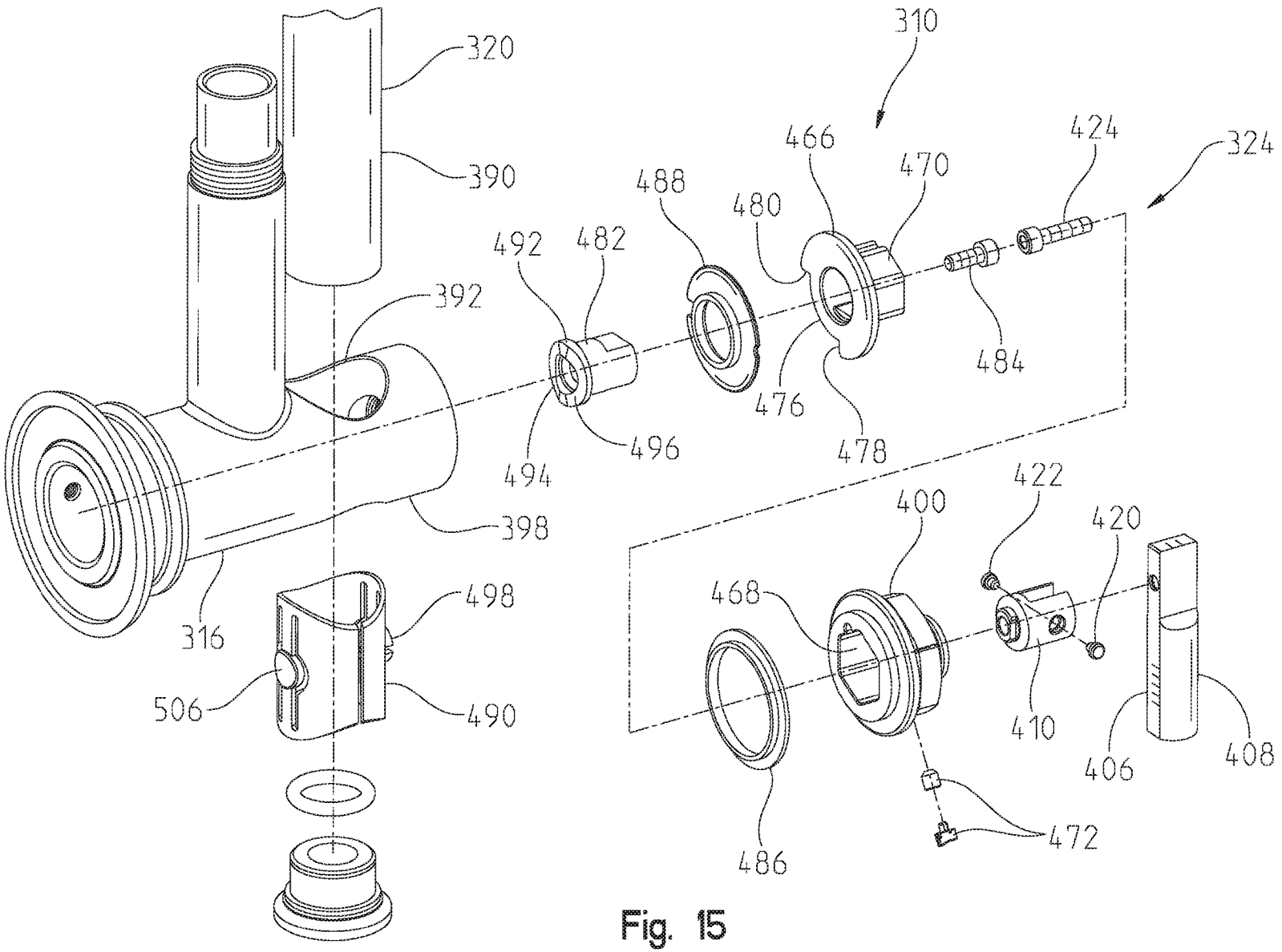
FIG. 15 is an exploded rear perspective view of the base and the neck of the shower head assembly of FIG. 10.

Referring briefly to FIGS. 12, 13, and 15, the securing device 490 and the main body 398 of the base 316 include features that facilitate installing and maintaining the securing device 490 in an appropriate position in the main body 398. Illustratively, the main body 398 includes a recess 504 and the securing device 490 includes a deflectable protrusion 506 that is received in the recess 504.

In addition to or as alternatives to the materials described above, illustrative shower head assemblies may comprise various materials, such as metals (for example, stainless steel, such as 316 stainless steel), plastics, combinations thereof (for example, a metal plated polymer), and the like. Illustrative shower head assemblies may be formed using various manufacturing processes. For example, one or more components of illustrative shower head assemblies may be formed using casting, molding, machining, additive manufacturing processes (for example, desktop fabrication or three dimensional printing), combinations thereof, and the like.

Although the invention has been described in detail with reference to certain preferred embodiments, variations and modifications exist within the spirit and scope of the invention as described and defined in the following claims.

What is claimed is:

1. A shower head assembly, comprising:

a base configured to be coupled to a building structure;

a neck including a vertically extending adjustment portion and a horizontally extending arm portion, the adjustment portion translatably coupled to the base for vertical movement through the base;

flexible tubing coupled to and configured to receive water from a shower head pipe, the flexible tubing extending external to and above the neck;

a shower head spout configured to receive water from the flexible tubing and discharge water from the shower head assembly, the shower head spout being coupled to the neck and translatable with the neck relative to the base to facilitate adjustment of the position of the shower head spout relative to the base; and a securing mechanism for selectively inhibiting translation of the neck and the shower head spout relative to the base.

2. The shower head assembly of claim 1, wherein the securing mechanism comprises a plurality of cantilevered arms for engaging the neck to selectively inhibit translation of the neck and the shower head spout relative to the base.

3. The shower head assembly of claim 2, wherein the securing mechanism further comprises a ramp device being rotatable to urge the plurality of cantilevered arms to engage the neck and selectively inhibit translation of the neck and the shower head spout relative to the base.

4. The shower head assembly of claim 1, wherein the securing mechanism comprises a first securing element for selectively engaging the neck to thereby selectively inhibit translation of the neck and the shower head spout relative to the base.

5. The shower head assembly of claim 4, wherein the securing mechanism further comprises a second securing element for engaging the neck opposite the first securing element.

6. The shower head assembly of claim 4, wherein the securing mechanism further comprises:

a roller device engaging the neck, the roller device rotating as the neck translates relative to the base; and a biasing element for urging the roller device into engagement with the neck.

7. The shower head assembly of claim 6, wherein the biasing element comprises a compression spring that is compressed between the first securing element and the roller device.

8. The shower head assembly of claim 4, wherein first securing element comprises a ramp, and wherein the securing mechanism further comprises:

a handle pivotably coupled to the base; and an arm coupled to the handle and being pivotable with the handle relative to the base, the arm sliding along the ramp as the handle pivots relative to the base to engage the first securing element with the neck to thereby selectively inhibit translation of the neck and the shower head spout relative to the base.

9. A shower head assembly, comprising:

a base configured to be coupled to a building structure;

a neck translatably coupled to the base;

flexible tubing coupled to and configured to receive water from a shower head pipe, the flexible tubing extending external to and above the neck;

a shower head spout configured to receive water from the flexible tubing and discharge water from the shower head assembly, the shower head spout being coupled to the neck and translatable with the neck relative to the base to facilitate adjustment of the position of the shower head spout relative to the base; and a securing mechanism for selectively inhibiting translation of the neck and the shower head spout relative to the base;

wherein the neck comprises:

an adjustment portion being translatable through the base and selectively securable by the securing mechanism to inhibit translation of the neck relative to the base; and a coupling portion coupled to the adjustment portion, the coupling portion being coupled to the shower head spout.

10. The shower head assembly of claim 1, wherein the neck is configured to receive water from the flexible tubing and the shower head spout is configured to receive water from the neck.

11. A shower head assembly, comprising:

a base configured to be coupled to a building structure;

a neck translatably coupled to the base;

flexible tubing coupled to and configured to receive water from a shower head pipe;

a shower head spout configured to receive water from the flexible tubing and discharge water from the shower head assembly, the shower head spout being coupled to the neck and translatable with the neck relative to the base to facilitate adjustment of the position of the shower head spout relative to the base;

a securing mechanism being selectively reconfigurable between a first configuration and a second configuration, in the first configuration, the securing mechanism inhibiting the neck and the shower head spout from translating relative to the base, and in the second configuration, the securing mechanism permitting the neck and the shower head spout to translate relative to the base;

wherein in the second configuration the securing mechanism and the flexible tubing provide resistance forces that inhibit the neck and the shower head spout from translating relative to the base, wherein the neck and the shower head spout do not translate relative to the base when movement forces are less than or equal to the resistance forces, and the neck and the shower head spout translate relative to the base when the movement forces are greater than the resistance forces; and wherein the resistance forces comprise:

a friction force due to engagement of the neck against the securing mechanism; and a reconfiguration force due to resistance to shape changes by the flexible tubing.

12. The shower head assembly of claim 11, wherein the securing mechanism comprises:

a cover coupled to the base; and a handle coupled to the cover, the cover being configured to be manipulated by a user.

13. The shower head assembly of claim 12, wherein the handle and the cover detachably couple to the base.

14. The shower head assembly of claim 12, wherein the handle and the cover are rotatable together relative to the base.

15. The shower head assembly of claim 11, wherein in the second configuration the securing mechanism and the flexible tubing provide resistance forces that inhibit the neck and the shower head spout from translating relative to the base, and the resistance forces comprise component weights, and the neck and the shower head spout do not translate relative to the base, when a user does not apply an external force to the neck or shower head spout, the component weights comprising the weight of the neck and the weight of the shower head spout.

16. The shower head assembly of claim 11, wherein the movement forces comprise an external force applied by a user to the neck or shower head spout, (1) when the external force is in a downward direction, the movement forces further comprise the weight of the neck and the weight of the shower head spout, and (2) when the external force is in an upward direction, the resistance forces further comprise the weight of the neck and the weight of the shower head spout.

17. A shower head assembly, comprising:

a base configured to be coupled to a building structure;

a neck translatably coupled to the base;

flexible tubing coupled to and configured to receive water from a shower head pipe;

a shower head spout configured to receive water from the flexible tubing and discharge water from the shower head assembly, the shower head spout being coupled to the neck and translatable with the neck relative to the base to facilitate adjustment of the position of the shower head spout relative to the base;

a securing mechanism being selectively reconfigurable between a first configuration and a second configuration, in the first configuration, the securing mechanism inhibiting the neck and the shower head spout from translating relative to the base, and in the second configuration, the securing mechanism permitting the neck and the shower head spout to translate relative to the base; and wherein the securing mechanism is carried within a chamber formed by the base.

18. A shower head assembly, comprising:

a base configured to be coupled to a building structure;

a neck translatably coupled to the base;

flexible tubing coupled to and configured to receive water from a shower head pipe;

a shower head spout configured to receive water from the flexible tubing and discharge water from the shower head assembly, the shower head spout being coupled to the neck and translatable with the neck relative to the base to facilitate adjustment of the position of the shower head spout relative to the base;

a securing mechanism being selectively reconfigurable between a first configuration and a second configuration, in the first configuration, the securing mechanism inhibiting the neck and the shower head spout from translating relative to the base, and in the second configuration, the securing mechanism permitting the neck and the shower head spout to translate relative to the base; and wherein the base is configured to receive water from the shower head pipe and deliver water to the flexible tubing.

19. The shower head assembly of claim 11, wherein the flexible tubing is external to and extends above the neck.

20. A shower head assembly, comprising:

a base configured to be coupled to a building structure;

a neck translatably coupled to the base;

flexible tubing coupled to and configured to receive water from a shower head pipe;

a shower head spout configured to receive water from the flexible tubing and discharge water from the shower head assembly, the shower head spout being coupled to the neck and translatable with the neck relative to the base to facilitate adjustment of the position of the shower head spout relative to the base;

a securing mechanism for inhibiting translation of the neck and the shower head spout relative to the base, the securing mechanism comprising:

a roller device engaging the neck, the roller device rotating as the neck translates relative to the base; and a securing element for engaging the neck opposite the roller device;

wherein the securing element and the flexible tubing provide resistance forces that inhibit the neck and the shower head spout from translating relative to the base, wherein the neck and the shower head spout do not translate relative to the base when movement forces are less than or equal to the resistance forces, and the neck and the shower head spout translate relative to the base when the movement forces are greater than the resistance forces.

21. The shower head assembly of claim 20, wherein in the securing element and the flexible tubing provide resistance forces that inhibit the neck and the shower head spout from translating relative to the base, and the resistance forces comprise component weights, and the neck and the shower head spout do not translate relative to the base, when a user does not apply an external force to the neck or shower head spout, the component weights comprising the weight of the neck and the weight of the shower head spout.

22. The shower head assembly of claim 21, wherein the resistance forces comprise a friction force due to engagement of the neck against the securing element.

23. The shower head assembly of claim 20, wherein the movement forces comprise an external force applied by a user to the neck or shower head spout, (1) when the external force is in a downward direction, the movement forces further comprise the weight of the neck and the weight of the shower head spout, and (2) when the external force is in an upward direction, the resistance forces further comprise the weight of the neck and the weight of the shower head spout.

24. The shower head assembly of claim 20, wherein the flexible tubing is external to and extends above the neck.

* * * * *